US010781012B2

(12) United States Patent
Bratsch

(10) Patent No.: US 10,781,012 B2
(45) Date of Patent: Sep. 22, 2020

(54) LID OF A CONTAINER

(75) Inventor: Christian Bratsch, Salzburg (AT)

(73) Assignee: XOLUTION GmbH, Munich (DE)

( * ) Notice: Subject to any disclaimer, the term of this patent is extended or adjusted under 35 U.S.C. 154(b) by 732 days.

(21) Appl. No.: 13/820,880

(22) PCT Filed: Sep. 5, 2011

(86) PCT No.: PCT/EP2011/065247

§ 371 (c)(1),
(2), (4) Date: Jul. 29, 2013

(87) PCT Pub. No.: WO2012/031994

PCT Pub. Date: Mar. 15, 2012

(65) Prior Publication Data

US 2013/0320013 A1 Dec. 5, 2013

(30) Foreign Application Priority Data

Sep. 7, 2010 (AT) ..... A 1490/2010

(51) Int. Cl.
*B65D 17/28* (2006.01)
*B65D 47/28* (2006.01)
(Continued)

(52) U.S. Cl.
CPC ..... *B65D 17/4014* (2018.01); *B65D 47/286* (2013.01); *B65D 51/007* (2013.01); *B65D 51/1672* (2013.01)

(58) Field of Classification Search
CPC ..... B65D 51/1677; B65D 51/007; B65D 2517/0038; B65D 2517/0035;
(Continued)

(56) References Cited

U.S. PATENT DOCUMENTS 3,272,382 A * 9/1966 Stec ..... 220/273
3,401,821 A * 9/1968 Bozek ..... 220/270
(Continued)

FOREIGN PATENT DOCUMENTS

CN 2807839 5/2007
DE 19613246 10/1997
(Continued)

OTHER PUBLICATIONS

English Abstract of DE19613246.
(Continued)

*Primary Examiner* — Anthony D Stashick
*Assistant Examiner* — Raven Collins
(74) *Attorney, Agent, or Firm* — Dykema Gossett PLLC

(57) ABSTRACT

The invention relates to a lid (100) of a container, especially a beverage can, comprising a substantially flat lid surface (101) and a preferably folded edge area (102), as well as at least one pouring opening (103) provided on the lid surface (101), which can be closed in a gas- and/or liquid-tight manner by means of at least one closure element (120), with the closure element (120) being movable from a closed position into an open position by means of an actuating element (110), the actuating element (110) comprises a fixing element (111) and a sliding element (113), and the fixing element (111) is connected to at least one connecting element (115) via at least one predetermined breaking point before opening for the first time and the fixing element (111) has a handle (114) which, upon movement of the fixing element (111) from the closed position into the open position, acts on the at least one predetermined breaking point via at least one edge (114*a*).

6 Claims, 5 Drawing Sheets

(51) Int. Cl.
*B65D 51/16* (2006.01)
*B65D 51/00* (2006.01)

(58) Field of Classification Search
CPC .... B65D 2517/0016; B65D 2517/0014; B65D 2517/0011; B65D 2251/02; B65D 2251/00; B65D 17/166; B65D 17/00; B65D 1/12; B65D 47/36; B65D 2543/00
USPC ..... 426/397, 131; 220/270, 256.1, 256, 220/254.9, 254.3, 254.1, 254; 206/217, 206/216
See application file for complete search history.

(56) References Cited

U.S. PATENT DOCUMENTS

| | | | | | |
|---|---|---|---|---|---|
| 3,705,670 | A * | 12/1972 | Douty | 222/541.9 | |
| 3,705,671 | A | 12/1972 | Douty | | |
| 3,804,287 | A * | 4/1974 | Balocca | B65D 17/503 | 220/271 |
| 3,952,911 | A * | 4/1976 | Bozek et al. | 220/269 | |
| 4,136,797 | A * | 1/1979 | Potts | 220/271 | |
| 4,162,742 | A | 7/1979 | Vogt | | |
| 4,170,724 | A | 10/1979 | Waterbury | | |
| 4,369,888 | A * | 1/1983 | Walter | B65D 47/141 | 215/237 |
| 4,410,101 | A | 10/1983 | Vogt | | |
| 4,746,032 | A * | 5/1988 | Huang | 220/255 | |
| 5,086,941 | A | 2/1992 | English et al. | | |
| 6,158,608 | A | 12/2000 | Schlattl | | |
| 6,626,314 | B1 | 9/2003 | McHenry et al. | | |
| 6,763,963 | B1 * | 7/2004 | Martin | 220/254.2 | |
| 7,918,359 | B2 | 4/2011 | Paris et al. | | |
| 8,336,726 | B2 * | 12/2012 | Ramsey | B65D 17/506 | 220/254.3 |
| 8,844,744 | B2 * | 9/2014 | Lucas | 220/254.3 | |
| 2007/0068943 | A1 * | 3/2007 | Ramsey | B65D 17/506 | 220/254.3 |
| 2008/0078763 | A1 * | 4/2008 | Auer | 220/254.3 | |
| 2008/0223810 | A1 | 9/2008 | Garcia | | |
| 2008/0314904 | A1 | 12/2008 | Perra | | |
| 2009/0179033 | A1 * | 7/2009 | Ramsey et al. | 220/271 | |
| 2013/0228586 | A1 * | 9/2013 | Schandl | 220/825 | |

FOREIGN PATENT DOCUMENTS

| | | |
|---|---|---|
| DE | 19613256 | 10/1997 |
| DE | 19706112 | 4/1998 |
| DE | 19746539 | 3/1999 |
| DE | 20319105 | 4/2004 |
| EP | 1190952 | 3/2002 |
| EP | 1247752 | 10/2002 |
| WO | 0433502 | 6/1991 |
| WO | 9965780 | 12/1999 |
| WO | 2006009450 | 1/2006 |

OTHER PUBLICATIONS

English Abstract of DE19613256.
English Abstract of DE19706112.
English Abstract of DE19746539.
English Abstract of DE20319105.
English Abstract of CN 2897839.

* cited by examiner

LID OF A CONTAINER

BACKGROUND OF THE INVENTION

Field of the Invention

The invention relates to a lid of a container, especially a beverage can, comprising a substantially flat lid surface and a preferably folded edge area, as well as at least one pouring opening provided on the lid surface which can be closed in a gas- and/or liquid-tight manner by at least one closure element, with the closure element being movable from a closed position into an open position by an actuating element, which includes a fixing element and a sliding element, and the fixing element is connected to at least one connecting element via at least one predetermined breaking point before opening for the first time.

THE PRIOR ART

Numerous beverage cans have become known which have a re-closable pouring opening. DE 196 13 246 A1 for example discloses a closure means having substantially the same diameter which is applied to the already existing lid, which closure means closes a pouring opening disposed in the lid by twisting. Similar apparatuses where some of these closure means cover the lid only partly have been described in DE 196 13 256 B4, DE 197 06 112 C2, EP 1 247 752 B1 or U.S. Pat. No. 6,626,314 B1. The disadvantageous aspect in these closure means is their mostly complex arrangement which additionally requires constructional changes to the lid region of the can.

A further group of closure means for beverage cans consists of a pull tab which is fastened by means of a rivet connection to the can lid, with the handle part of the pull tab being arranged simultaneously as the closure means for the pouring opening, which after the opening of the pouring opening seals the pouring opening again by twisting and/or folding down the pull tab. Such elements are shown, among other things, in DE 197 46 539 A1, DE 203 19 105 U1, EP 1 190 952 A2, EP 1 097 086 B1 and EP 0 433 502 A1. These beverage cans all have a closure means which is applied from the outside to the pouring opening and partly protrudes beyond the lid edge, so that the same can be removed inadvertently and the content of the can is exposed to the ambient environment.

EP 1 796 974 B1 finally describes a closure apparatus for a beverage can of the type mentioned initially, in which an actuating element is provided which has a fixing and a sliding element in order to expose a drinking opening and close it again. A disadvantageous aspect of this apparatus is its complex structure and its only inadequate tightness in practice after opening for the first time, especially over a longer period of time. At first glance, it is equally little apparent for the user whether the beverage can has already been opened once.

It is therefore the object of the invention to provide a re-closable lid for containers which is easy to operate and has a high tightness upon re-closure and furthermore acts as a tamper-evident closure.

SUMMARY OF THE INVENTION

This object is achieved in accordance with the invention by a lid of the kind mentioned above in such a way that the fixing element has a handle which, upon moving the fixing element from the closed position into the open position, acts upon the at least one pre-determined breaking point by means of at least one edge. The handle allows an intuitive opening of the beverage can, with this opening being accomplished with little expenditure of force as a result of the edge effect of the handle.

For this purpose, it is preferably provided that the fixing element can be pivoted from a plane which is disposed substantially parallel to the lid surface, whereby a lever force acts directly or indirectly via the at least one edge of the handle on the at least one predetermined breaking point.

In a preferred variant of the invention, the fixing element is in non-detachable articulated communication with the sliding element, which is preferably configured as a film hinge. The fixing element with the handle disposed thereon is used for fixing the sliding element in the closed position of the actuating element whereas the sliding element is connected to the closure element and upon displacement of the actuating element by means of sliding element, a pouring opening is exposed.

In addition, it is preferably provided that the at least one connecting element is disposed on the mirror surface in order to function as a component of a tamper-evident closure.

In a further embodiment of the invention, the handle is T-shaped or Y-shaped, whereby a particularly easy operation of the fixing element is made possible.

In a particularly preferred embodiment of the invention, a pressure compensating opening is provided, which is exposed upon movement of the fixing element and/or sliding element into the open position. This pressure compensating opening has the task of allowing pressure compensation with the can interior before or during opening of the pouring opening in order to facilitate opening and avoiding the can contents spraying out.

In order to close this pressure compensating opening in a gas- and liquid-tight manner when reclosing the container, in a further preferred embodiment of the invention, a closure element, in particular a pin, is provided on the fixing element, which engages in the pressure compensating opening when the fixing element is located in the closed position.

A particularly tight closure device of the type in accordance with the invention is achieved if the at least one actuating element is displaceable substantially linearly and parallel to the lid.

The invention will now be explained in greater detail by reference to non-limiting embodiments with relevant FIGS. 1 to 6*a*.

DETAILED DESCRIPTION OF THE DEPICTED EMBODIMENT

Figure 1:
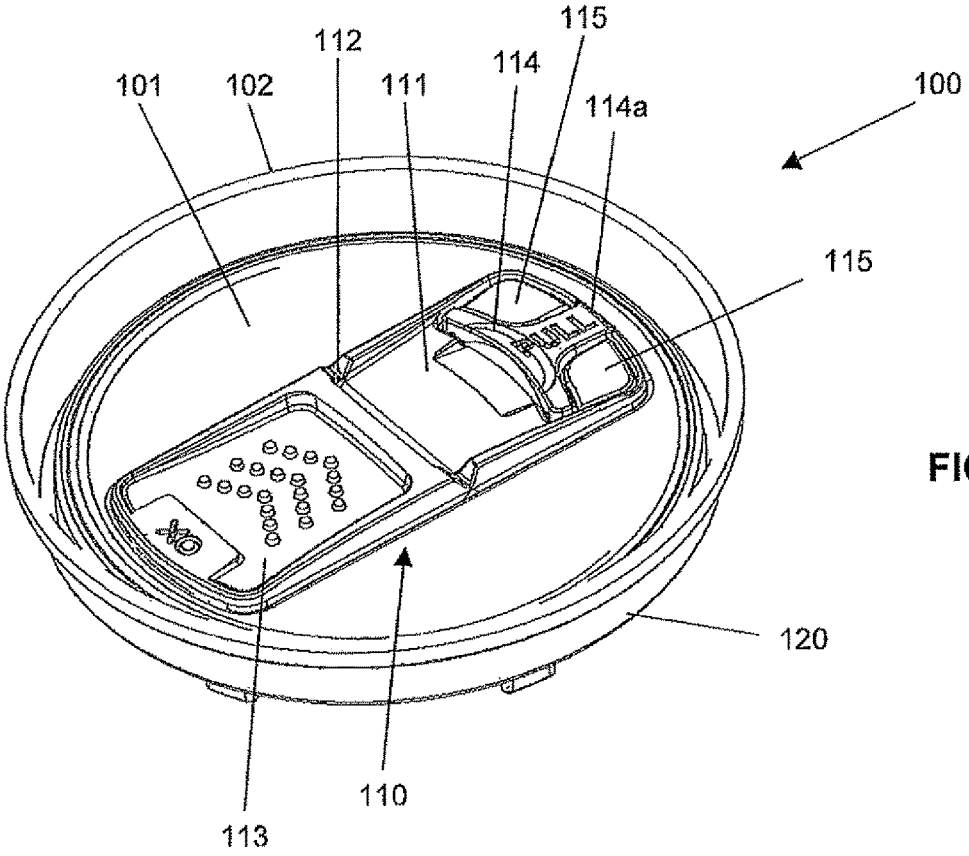
FIG. 1 is a perspective top view of a lid according to an embodiment of the invention.
Figure 1A:
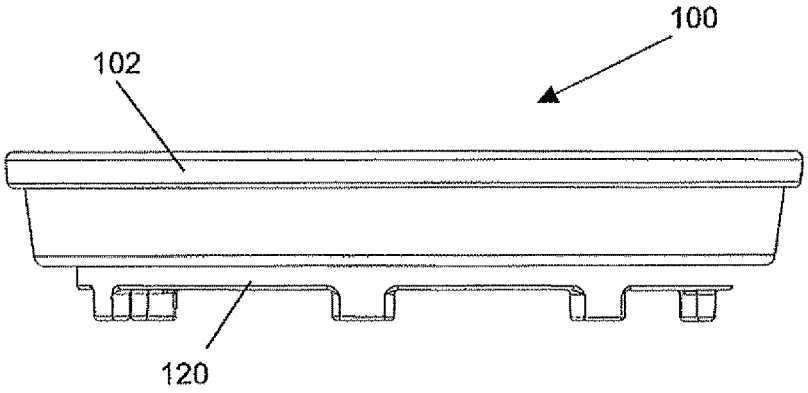
FIG. 1*a* is an elevational side view thereof.
Figure 1B:
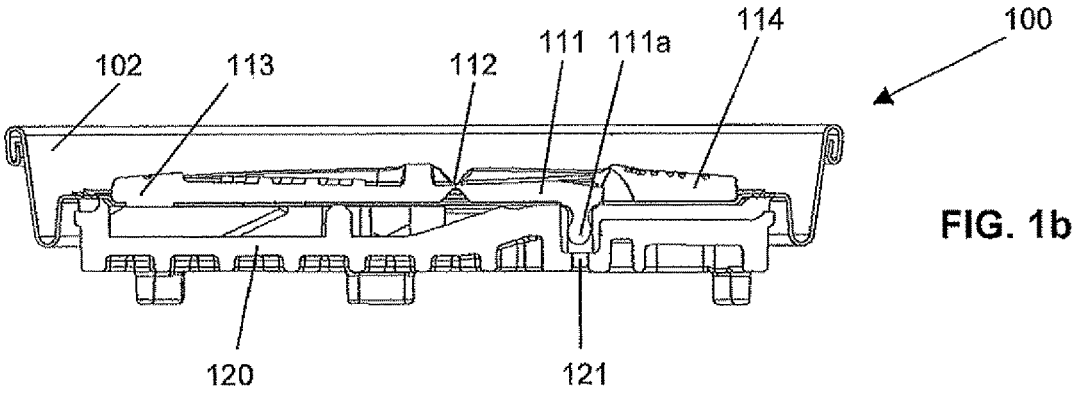
FIG. 1*b* is a cross-sectional view thereof.

FIGS. 1, 1*a*, 1*b* show a lid 100 according to the invention having a substantially flat lid surface 101 as well as a flanged edge 102 in its closed state before the first opening.

The lid 100 has a substantially two-part actuating element 110 with a fixing element 111 that is connected by means of an articulated connection 112, for example, a film hinge, to a sliding element 113. A handle 114 is additionally provided in the fixing element 111, which handle is configured to be substantially Y-shaped in this variant of the invention. The actuating means 110 is connected to a closure element 120 that, in the closed position, closes a pouring opening 103 of the container, in particular the beverage can.

A pressure compensating opening 121 is provided in the closure element 120, which opening allows the excess pressure frequently prevailing in the interior of beverage cans to escape before the pouring opening is exposed. Any spraying out of liquid from the beverage can is thereby prevented and the actual opening of the can is made easier. A pin 111*a* disposed on the fixing element 111 projects into the pressure compensating opening 121 here, which pin 111*a* closes the pressure compensating opening 121 in a gas- and liquid-tight manner in the closed position of the actuating means 110.

Figure 2:
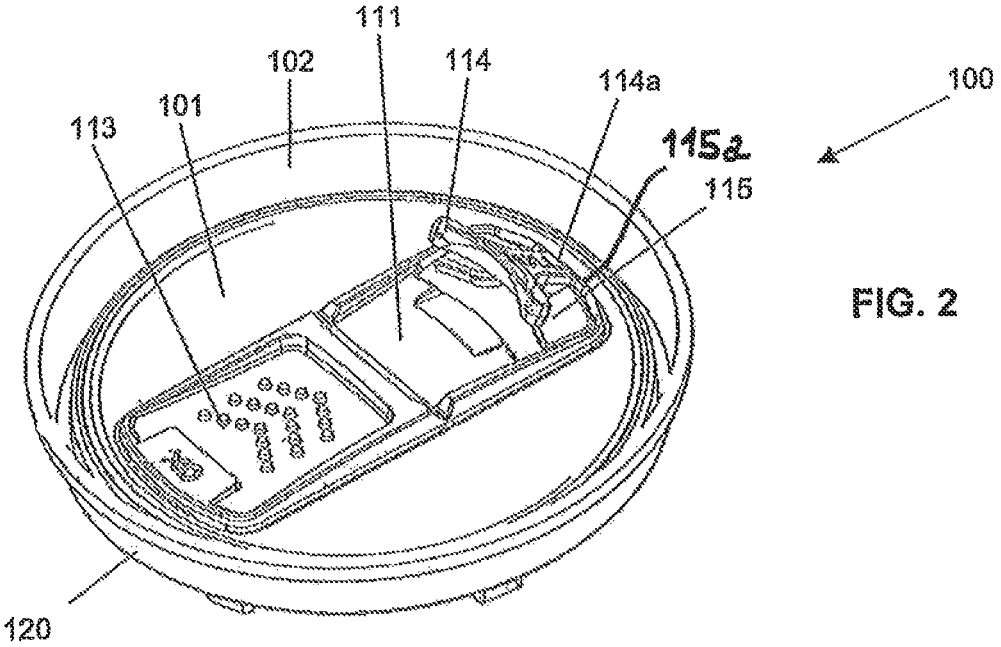
FIG. 2 is a perspective top view of the lid with the handle lifted.

By lifting the handle 114 (FIG. 2), it is separated from two connecting elements 115 to which it has been connected via one or more predetermined breaking points 115*a*. The primary function of the connecting element 115 consists in fixing the closure of the beverage can on the lid surface 101 during assembly. In so doing, the narrow edge 114*a* of the handle 114 acts as a contact surface for the lever action of the handle 114, whereby a greater force acts on the at least one predetermined breaking point, usually located in the immediate vicinity, than if merely a tensile force had been applied via the handle 114.

Figure 3:
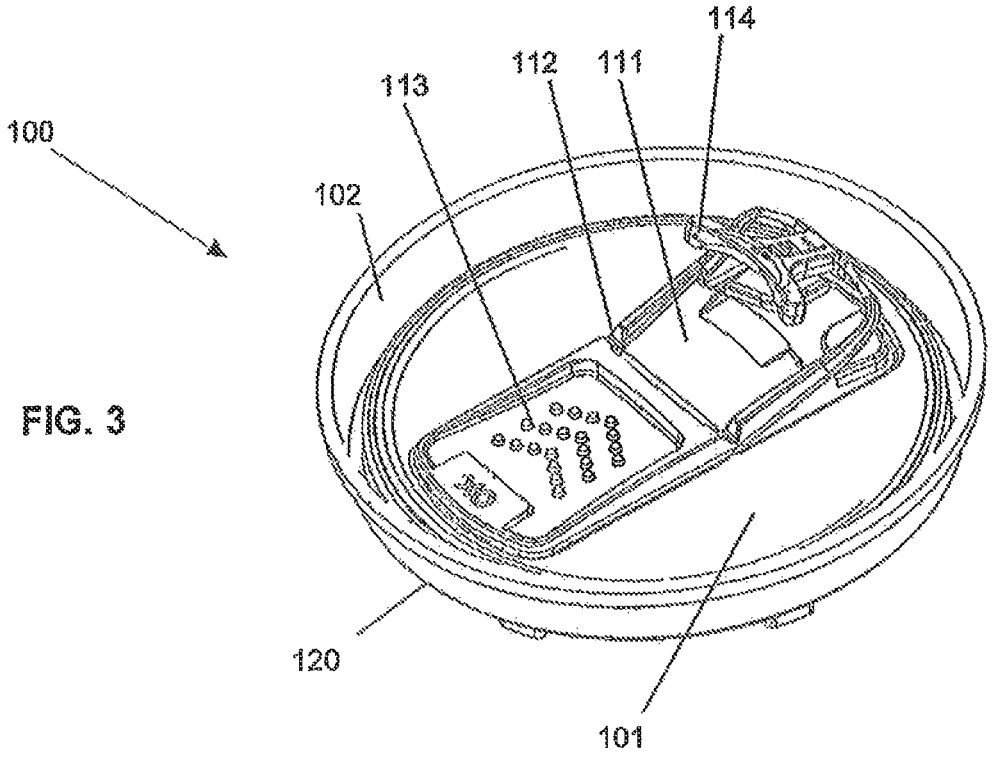
FIG. 3 is a perspective top view of the lid with the fixing element raised.
Figure 3A:
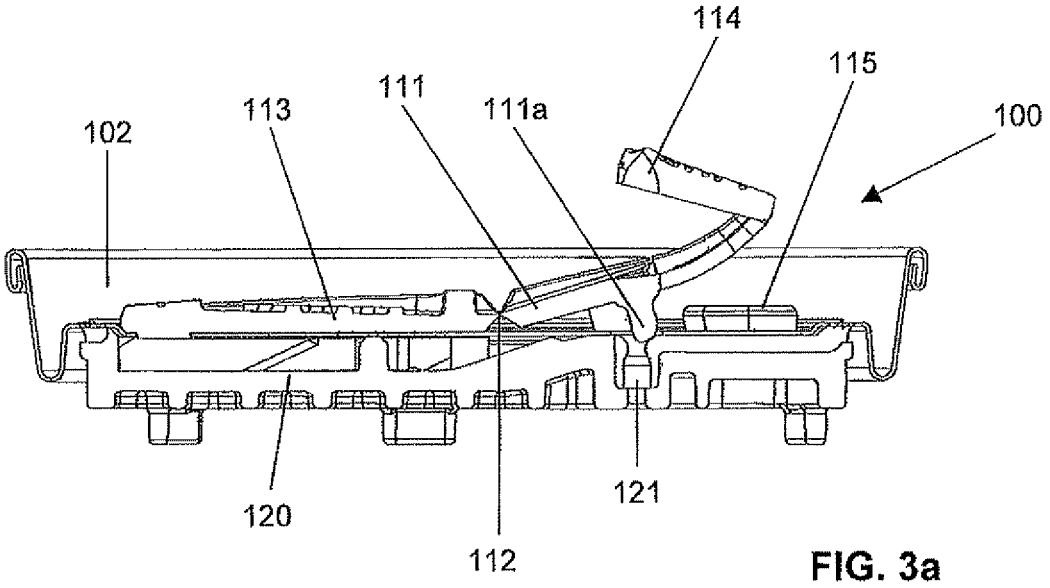
FIG. 3*a* is a cross-sectional view of the lid as depicted in FIG. 3.

Due to a substantially pulling opening of the handle 114, in a further step the fixing element 111 is raised and completely separated from the connecting element 115, with the pin 111*a* being withdrawn simultaneously from the pressure compensating opening 121 and pressure equalization being able to take place (FIGS. 3 and 3*a*).

Figure 4:
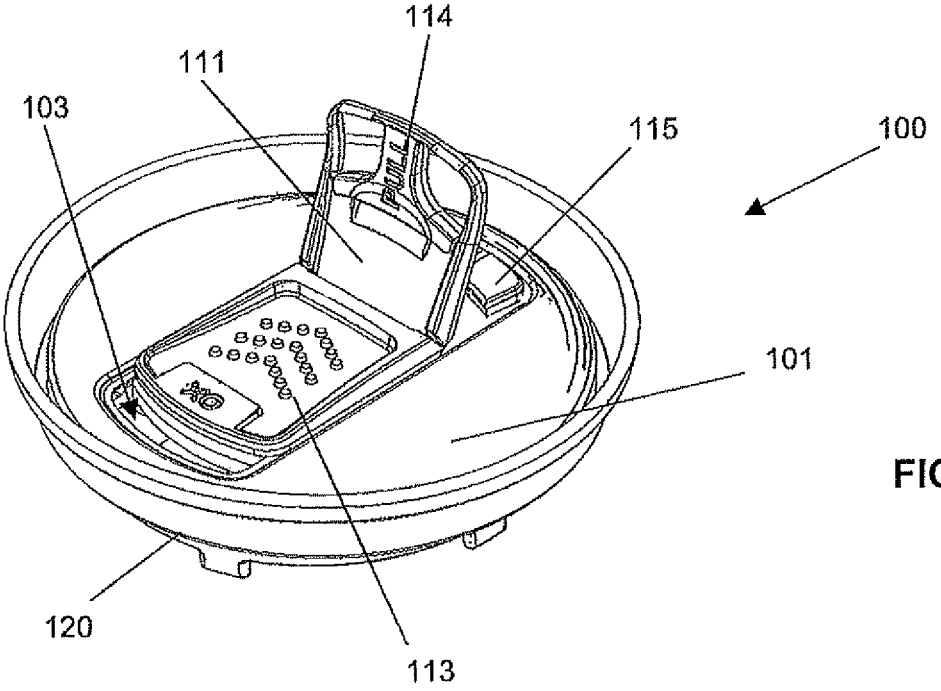
FIG. 4 is a perspective top view of the lid with the handle positioned in the fixing element.
Figure 4A:
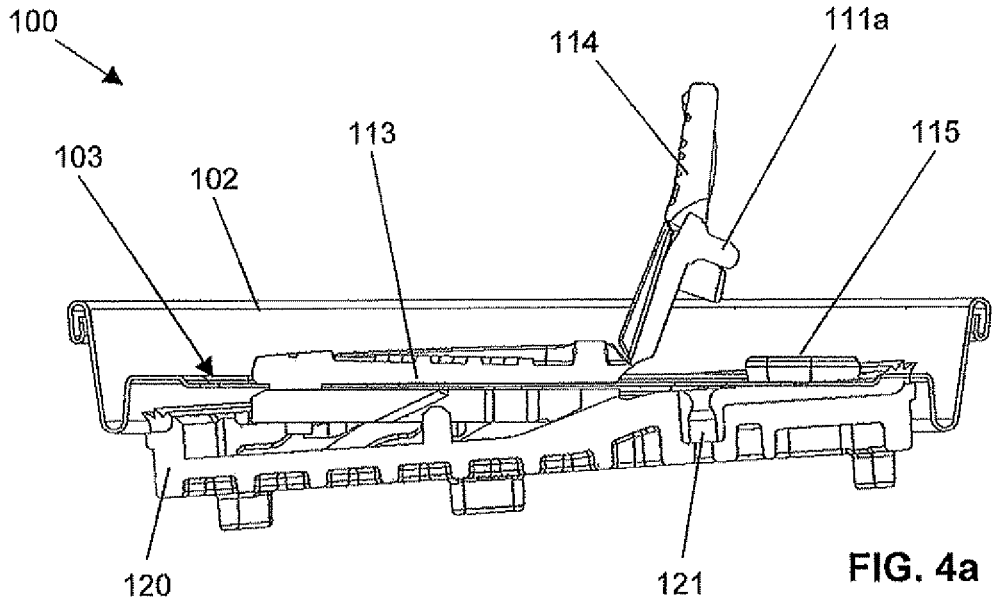
FIG. 4*a* is a cross-sectional view of the lid as depicted in FIG. 4.
Figure 5:
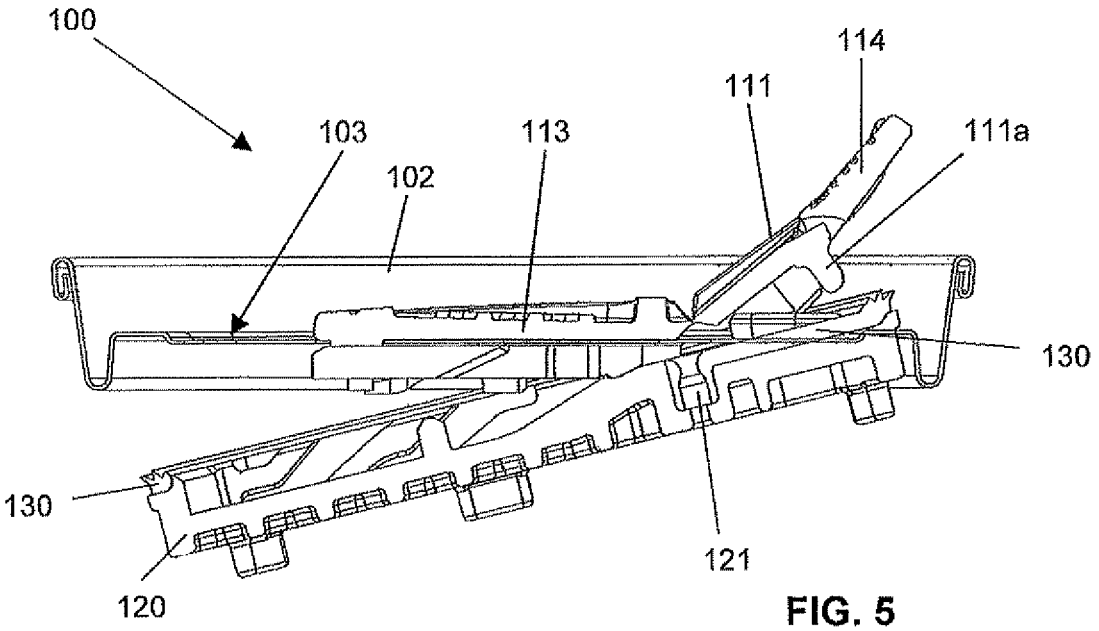
FIG. 5 is a cross-sectional view of the lid with the drink opening opened.

As soon as the pulling movement is completed, the handle 114 is again disposed inside the fixing element 111 and the sliding element 113 can now be displaced in the direction of the connecting element 115 in order to expose the drinking opening 103 (FIGS. 4, 4*a* and 5).

Through displacement of the actuating element 110, the closure element 120 is pivoted into the interior of the can and the pouring opening 103 exposed.

Figure 6:
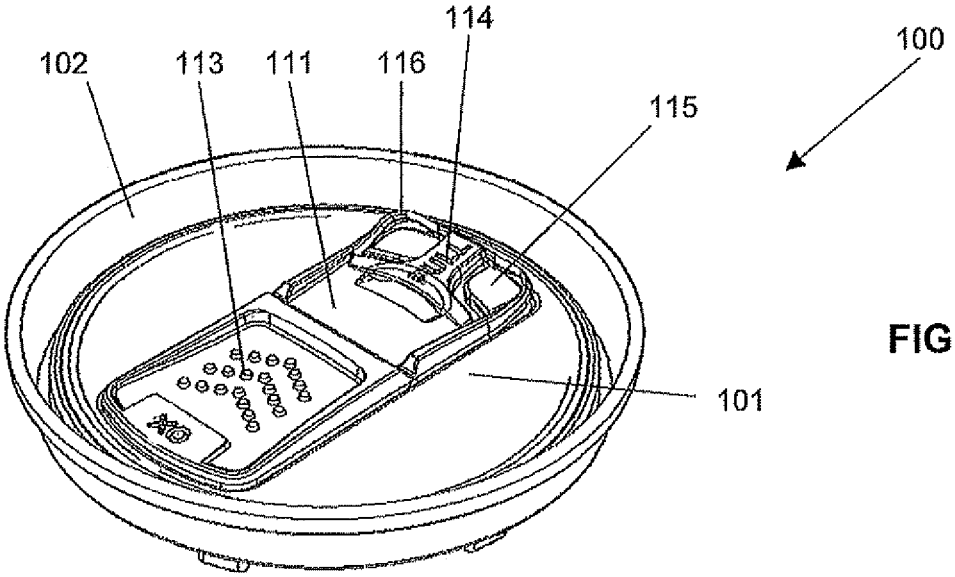
FIG. 6 is a perspective view of the lid when re-closed.
Figure 6A:
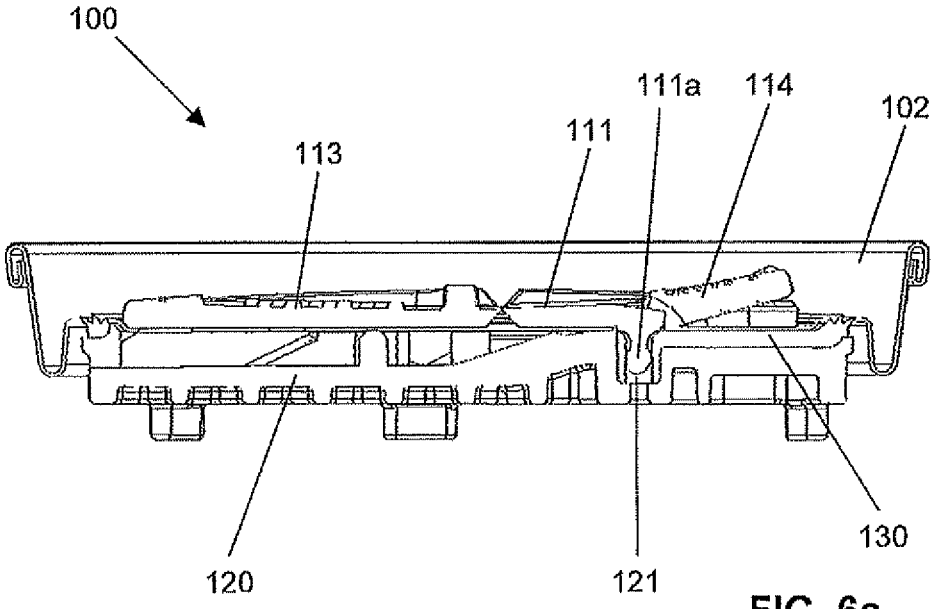
FIG. 6*a* is a cross-sectional view of the lid as depicted in FIG. 6.

For re-closure the actuating element 110 is pushed back into the original position whereby the closure element 120 is again disposed parallel to the lid surface 110 and as a result of a peripheral seal 130, which additionally encloses the pressure compensating opening 121, the closure element 120 closes the pouring opening 103 in a gas- and liquid-tight manner (FIGS. 6 and 6*a*).

Likewise, the pin 111*a* is again disposed in the pressure compensating opening 121 by lowering the fixing element 111 so that this is closed in a gas- and liquid-tight manner toward the outside. Since a connecting part 116 between handle 114 and fixing element 111 is made of thin material, upon first actuation of the handle 114, in particular upon tearing the predetermined breaking points, this connecting part 116 is stretched so that upon re-closure of the beverage can, this can conspicuously no longer be disposed in a precisely fitting manner around the connecting element 115. In particular, it is apparent in FIG. 6*a* that as a result the handle 114 no longer comes to rest completely flat on the lid surface 101. It can thus be identified immediately that the beverage can has already been opened once.

In order to hold the fixing element 111 in the closed position without it being able to be raised unintentionally and thereby expose the pressure compensating opening 121, for example, latching pins are provided which engage in corresponding recesses of the closure element 120 and which allow a pivoting of the fixing element 111 and therefore an opening of the beverage can only with a certain application of force. The latching pins can, for example, be configured in such a manner that the engagement causes a clearly audible noise that indicates to the user that the beverage can has been (re-)closed as prescribed.

The embodiments of the invention as described above shall be understood in a non-limiting manner. Thus, the closure device according to the invention can also be configured without or with more than one pressure compensating opening. Likewise there are no limits on the shape of the handle as long as it applies a sufficiently strong force, in particular a direct or indirect lever action, on at least one predetermined breaking point and is easy for the user to grip.

The invention claimed is:

1. A lid of a container, comprising a substantially flat lid surface, a folded edge area, a pouring opening provided on the lid surface which can be closed in a gas- and/or liquid-tight manner by a closure element disposed in an area of an underside of the lid surface, with the closure element being movable from a closed position into an open position and back again into a reclosed position by an actuating element, wherein the closure element is pivoted into an interior of the container to expose the pouring opening, the actuating element comprising a fixing element and a sliding element, wherein the fixing element is in non-detachable articulated communication with the sliding element at a first end of the fixing element, and the fixing element being connected to at least one connecting element via at least one predetermined breaking point before opening for the first time, a handle which, upon movement of the fixing element from the closed position into the open position, acts on the at least one predetermined breaking point via at least one edge, wherein a connecting part between the handle and the fixing element is provided at a second end of the fixing element opposite to the first end, and wherein the at least one connecting element is disposed on the lid surface, and by lifting the handle is separated from the at least one connecting element, and a pressure-compensating opening located in the closure element which is exposed upon movement of the fixing element into the open position, wherein a pin is disposed on the fixing element that engages in the pressure-compensating opening when the fixing element is in the closed position.

2. The lid according to claim 1, wherein the fixing element can be pivoted from a plane which is disposed substantially parallel to the lid surface.

3. The lid according to claim 1, wherein the articulated connection is configured as a film hinge.

4. The lid according to claim 1, wherein the handle is T-shaped or Y-shaped.

5. The lid according to claim 1, wherein at least one actuating element is displaceable substantially linearly and parallel to the lid surface.

6. A lid for a container, said lid comprising:

a panel and a flanged periphery, said panel providing a substantially flat top and an underside, and including a pouring hole which extends from the top to the underside, and a connecting element which extends upwardly from the top, a closure member located beneath the panel and pivotable relative to the panel to sealingly close or reclose the pouring hole or open the pouring hole, said closure member including a pressure-compensating hole therethrough, and an actuating member for pivoting the closure member relative to the panel, the actuating member including a fixing element and an inter-connected sliding element, the fixing element including a handle to enable the fixing element to be moved from a closed position wherein the fixing element is connected to the connecting element at a predetermined breaking point to an open position wherein the sliding element pivots the closure member to open the pouring hole, the fixing element including a pin which extends into and seals the pressure-compensating hole when the fixing element is in the closed position but is removed from the pressure-compensating hole when the fixing element is in the open position, wherein the fixing element is in non-detachable articulated communication with the sliding element at a first end of the fixing element and wherein a connecting part between the handle and the fixing element is provided at a second end of the fixing element opposite to the first end.

* * * * *